United States Patent [19]

Tertinek et al.

[11] 4,113,403

[45] Sep. 12, 1978

[54] PLATE TYPE COMPACTOR

[75] Inventors: Christian T. Tertinek, Canandaigua; Alan J. Stone, Honeoye, both of N.Y.

[73] Assignee: Stone Construction Equipment Inc., Honeoye, N.Y.

[21] Appl. No.: 829,581

[22] Filed: Aug. 31, 1977

[51] Int. Cl.[2] ..... E01C 19/38

[52] U.S. Cl. ..... 404/113

[58] Field of Search ..... 404/113, 117, 133, 114

[56] References Cited

U.S. PATENT DOCUMENTS

| | | | |
|---|---|---|---|
| 2,737,094 | 3/1956 | Jackson | 404/113 |
| 2,856,828 | 10/1958 | Brown | 404/113 |
| 3,052,166 | 9/1962 | Thrun | 404/117 |
| 3,232,188 | 2/1966 | Frohnauer | 404/133 X |
| 3,257,918 | 6/1966 | Garis | 404/117 |
| 3,279,338 | 10/1966 | Briggs | 404/113 |
| 3,603,224 | 9/1971 | Dresher | 404/133 |
| 3,782,845 | 1/1974 | Briggs | 404/133 |
| 3,832,080 | 8/1974 | Stoecker | 404/133 |
| 3,878,733 | 4/1975 | Tertinek | 404/113 X |
| 3,899,263 | 8/1975 | Briggs | 404/133 |

*Primary Examiner*—Nile C. Byers, Jr.

*Attorney, Agent, or Firm*—Clarence A. O'Brien; Harvey B. Jacobson

[57] ABSTRACT

A body of lubricant acting also as a coolant is confined by a housing to the base of a vibratory compactor, in direct contact with the planar bottom portion of the base. Upwardly inclined end portions of the base accommodate tilting of the machine in one direction for installation of wheel assemblies or in the other direction to drain all of the lubricant from the housing. A vibration generating, eccentric rotor within the housing mounts flow directing blades to effect misting of the lubricant during vibration and direct it toward critical lubricating points.

16 Claims, 18 Drawing Figures

PLATE TYPE COMPACTOR

BACKGROUND OF THE INVENTION

This invention relates to vibratory machines of the plate type for compacting ground surface materials such as soil and asphalt.

Vibratory compacting machines in which the vibration generated by rotation of an eccentric rotor is applied to a base plate in contact with the material being compacted, are well known as indicated by the prior U.S. patents hereinafter referred to. These machines have required a considerable amount of maintenance and repair because of the accumulation of dirt on confining surfaces, excessive wear of parts, inadequate lubrication and poor dissipation of heat. Further, maintenance and repair of such prior machines has required the use of many different and expensive tools and a high degree of skill. It is therefore an important object of the present invention to provide a base plate type of compacting machine designed to not only decrease wear, minimize accumulation of dirt and improve lubrication and heat dissipation, but to also facilitate maintenance and repair without sacrifice of performance and operating efficiency.

PRIOR ART STATEMENT

The following prior U.S. patents are known:

Brown et al. — 2,856,828 — Oct. 21, 1958
Briggs et al. — 3,279,338 — Oct. 18, 1966
Wells — 3,386,353 — June 4, 1968
McIlrath et al. — 3,416,417 — Dec. 17, 1968
Berkhoudt et al. — 3,453,940 — July 8, 1969
Dresher — 3,603,224 — Sept. 7, 1971
Danuser — 3,732,022 — May 8, 1973
Briggs et al. — 3,782,845 — Jan. 1, 1974
Maass — 3,806,269 — Apr. 23, 1974
Buck — 3,814,533 — June 4, 1974
Opderbeck — 3,817,646 — June 18, 1974
Stoecker — 3,832,080 — Aug. 27, 1974
Heckner — 3,883,260 — May 13, 1975
Sutherland — 3,972,637 — Aug. 3, 1976

The invention as claimed is believed to be a patentable improvement over the teachings in the foregoing prior U.S. patents.

SUMMARY OF THE INVENTION

In accordance with the present invention, the improved vibratory compactor includes a base having a planar bottom portion from which front and rear end portions extend upwardly at an incline to accommodate tilting of the base. A housing secured to the base spaced from lateral side portions confines a body of lubricant between the front and rear end portions in direct, heat transfer contact with the planar bottom portion. A vibration generating, eccentric rotor assembly is mounted within the housing above the planar bottom portion closer to the front end. A power generator such as an internal combustion engine is mounted on a deck secured to the base in straddling relation to the housing and located rearwardly of the eccentric rotor assembly to which it is drivingly connected by a drive belt.

Lateral flow directing blades are mounted on the eccentric rotor to mist the lubricant and direct it to critical lubricating points as well as to enhance heat dissipation from the bearing surfaces during vibration of the base. Heat transfer through the planar bottom portion of the base cools the lubricant and warms the material being compacted to avoid adhesion of such materials as asphalt.

To facilitate transport of the compactor when not in operation, readily removable wheel assemblies are installed by tilting the base about its front end portion. Lateral extensions of fasteners securing the engine mounting deck to the base receive the wheel mounting brackets of the wheel assemblies during installation. When the load of the machine is transferred to the wheels upon restoration of the base to its horizontal position, the pivotal wheel brackets are locked between the base and the handle pivotally connected to the engine deck.

When the base is tilted onto its rear end portion, all of the lubricant in the housing may be drained by gravity from a fill or drain opening located on the housing at the rear end. The level of lubricant may also be checked through a dip stick inserted into the fill opening when unplugged. During vibration of the base, the lubricant will be displaced into contact with the eccentric rotor assembly causing impact between lubricant droplets and the flow directing blades aforementioned.

The eccentric rotor assembly is rotatably supported within the housing by roller bearings assembled within bearing supports secured to the side walls of the housing by fasteners that may be removed and used to effect disassembly of the bearings and rotor through unplugged bores formed in the bearing supports. The rotational axis of the rotor is located above the planar bottom plate but forwardly of the engine to produce peak amplitude vibration adjacent the front end and reduced amplitude vibration underlying the engine. This causes forward advancement of the machine and less vibration of the engine. Interchangeable shock mounts are used at the connections between the engine deck and the base and at the pivotal connection of the handle to the base in underlying relation to the engine. The pivotal mounting of the handle may be changed from a limited swing position to an unrestricted swing position as required.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWING FIGURES

DETAILED DESCRIPTION OF A PREFERRED EMBODIMENT

Figure 1:
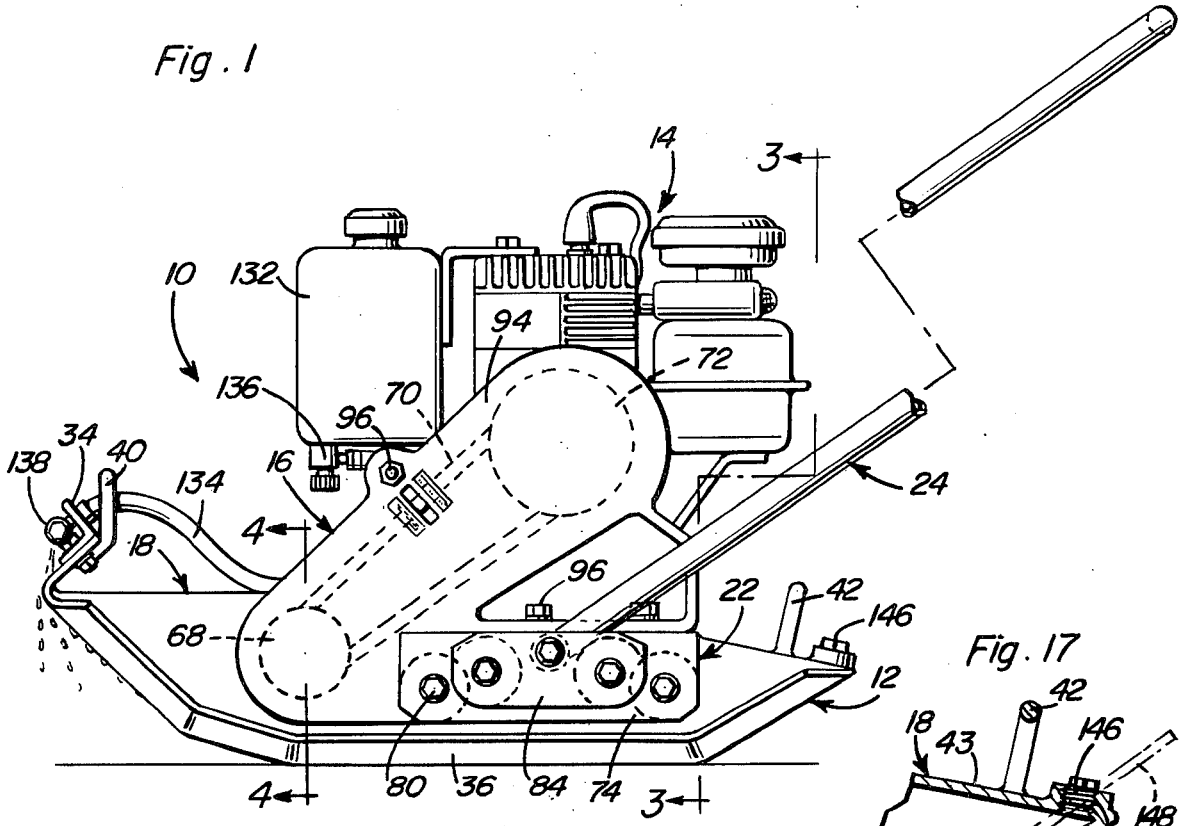
FIG. 1 is a side elevation view of a vibratory compacting machine constructed in accordance with the present invention.
Figure 2:
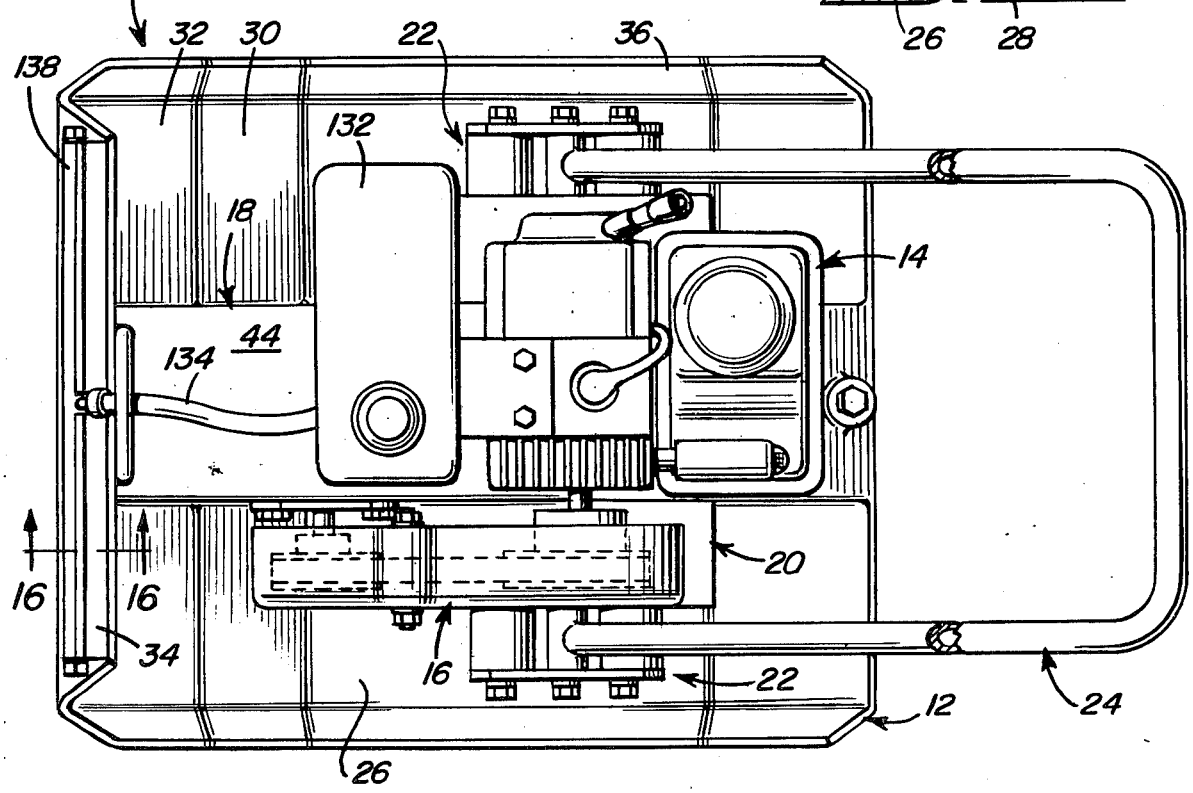
FIG. 2 is a top plan view of the compacting machine shown in FIG. 1.

Referring now to the drawings in detail, FIGS. 1 and 2 illustrate a vibratory compacting machine of the plate type, generally referred to by reference numeral 10. The compacting machine includes a base generally referred to by reference numeral 12 through which the load of the machine is applied to the surface material being compacted. The base supports thereabove a power generator in the form of an internal combustion engine generally referred to by reference numeral 14. The engine is drivingly connected by means of an endless drive belt assembly 16 to a vibration generator located within a longitudinally elongated housing 18 mounted on the base 12. The engine 14 is mounted in an adjustably fixed position on the base by a mounting deck 20 secured to the base by means of a pair of laterally spaced shock mount assemblies 22. The shock mount assemblies also pivotally connect an inverted U-shaped handle 24 to the machine for pushing the machine in a forward direction or guiding its movement during vibration over the surface material being compacted.

Figure 7:
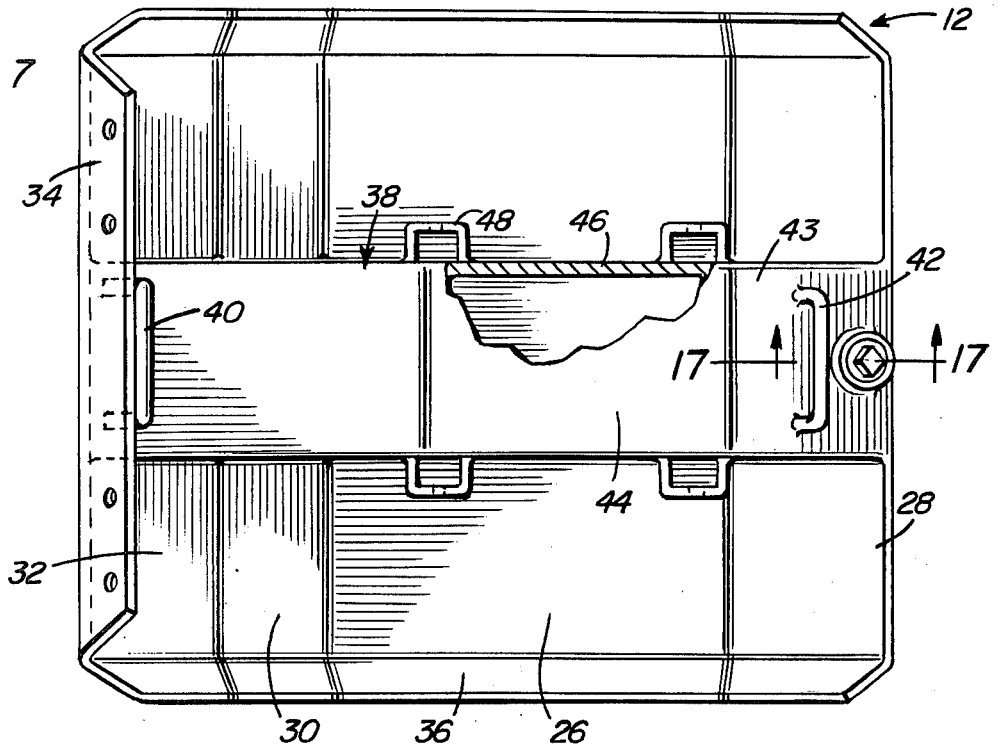
FIG. 7 is a top plan view, with parts broken away and shown in section, of the base associated with the compacting machine.

Referring now to FIGS. 1 and 7 in particular, the base 12 is of a generally rectangular shape having a planar bottom portion 26 adapted to contact the surface material to be compacted. At the rear end of the machine, the base is provided with a rear end portion 28 that is upwardly inclined from the planar bottom portion at a predetermined angle such as 30°. At the front end of the machine, the base 12 extends upwardly in two stages from the planar bottom portion 26 along inclined sections 30 and 32. At the extreme front end of the base, a rearwardly inclined flange 34 is formed for purposes to be explained hereinafter. The base is also formed with laterally inclined side portions 36. Secured to the base and extending between its front and rear ends is the inverted U-shaped housing 18 aforementioned. The housing is centrally located between the side portions 36 of the base and spaced therefrom. Lift handles 40 and 42 are secured to the front flange 34 of the base and to the top 44 of the housing on a downwardly inclined rear end portion 43. The laterally spaced sides 46 of the housing are provided with longitudinally spaced and aligned brackets 48 through which the shock mount assemblies 22 are secured to the machine.

Figure 4:
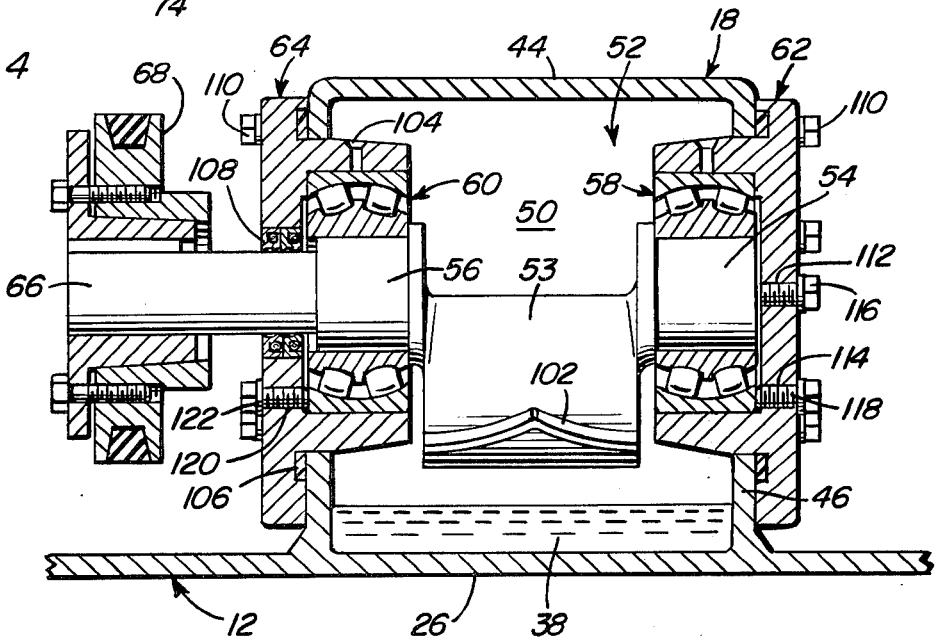
FIG. 4 is an enlarged partial sectional view taken substantially through a plane indicated by section line 4—4 in FIG. 1.

Referring now to FIG. 4 in particular, the housing 18 encloses a longitudinally elongated chamber 50 within which a body of lubricant such as oil 38 is confined in direct heat transfer contact with the planar bottom portion 26 of the base. A vibration generating assembly generally referred to by reference numeral 52 is mounted within the housing chamber 50 and includes an eccentric rotor 53 interconnected between a pair of rotor shaft sections 54 and 56 and spaced above the body of oil 38 in its static condition as shown. The shaft sections 54 and 56 are respectively journalled within roller thrust bearings 58 and 60 which are in turn assembled within bearing supports 62 and 64. A smaller diameter power shaft section 66 extends from the shaft section 56 externally of the housing and is connected to a driven pulley wheel 68 associated with the endless belt drive assembly 16 aforementioned. As shown by dotted line in FIG. 1, the driven pulley 68 is drivingly connected by an endless belt 70 within the drive assembly 16 to a drive pulley 72 connected to the engine output shaft. Accordingly, the engine will drive the vibration generating assembly 52 causing its eccentric rotor 53 to rotate and by virtue of the eccentricity of its mass relative to its rotational axis cause the base 12 to which the housing 18 is connected to vibrate at a predetermined frequency. The amplitude of this vibration will be maximum at the rotational axis of the eccentric rotor 53 or the driven pulley 68 aligned therewith adjacent the forward or front end of the machine above the planar bottom portion of the base as shown in FIG. 1. The engine 14 on the other hand is located closer to the rear end portion of the machine and will therefore experience vibration of a reduced amplitude in view of its rearward spacing along the base from the location of peak amplitude vibration at the rotational axis of the vibration generator. The vibration imparted to the engine from the base is furthermore reduced by the shock mount assemblies 22 through which the engine deck 20 is secured to the sides 46 of the housing by means of the brackets 48 aforementioned.

Figure 3:
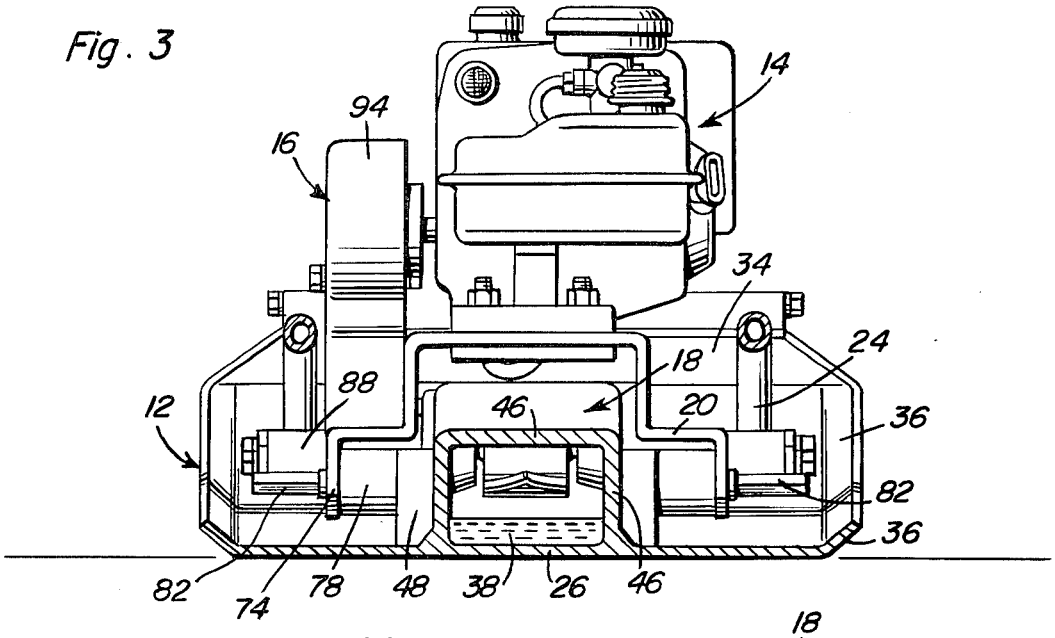
FIG. 3 is a front section view taken substantially through a plane indicated by section line 3—3 in FIG. 1.
Figure 8:
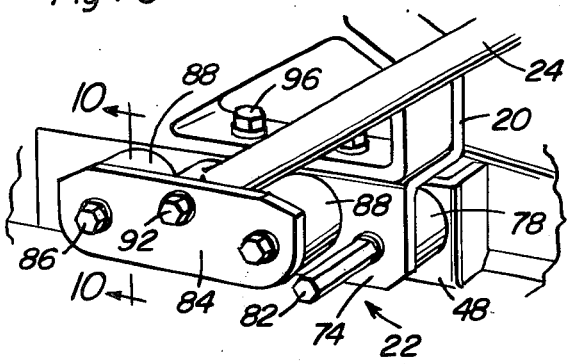
FIG. 8 is a partial perspective view showing a portion of the compacting machine at which the handle is pivotally connected thereto according to one operational mode.
Figure 9:
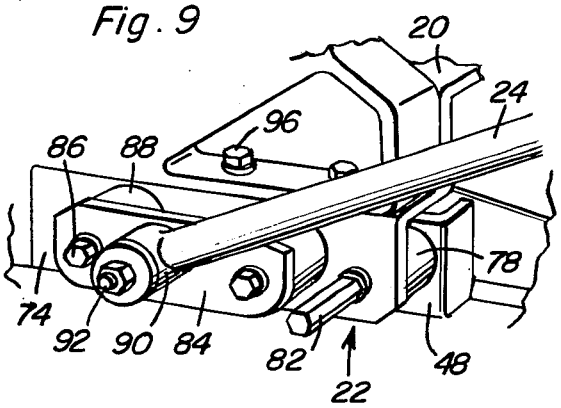
FIG. 9 is a partial perspective view similar to that of FIG. 8 but showing the handle pivotally attached to the machine in another operational mode.
Figure 10:
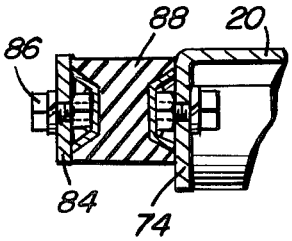
FIG. 10 is a partial section taken substantially through a plane indicated by section line 10—10 in FIG. 8.
Figure 15:
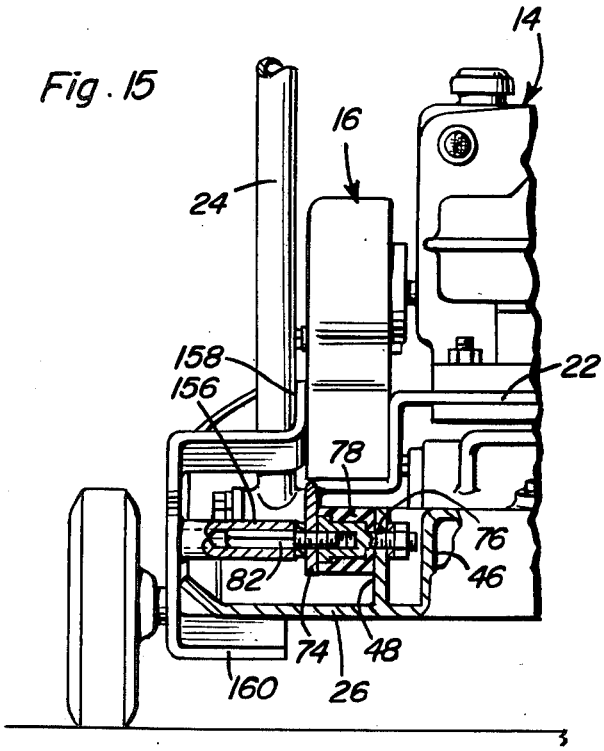
FIG. 15 is a partial rear elevation view of the compacting machine in the wheel supported position shown in FIG. 14, with portions broken away and shown in section.

As more clearly seen in FIG. 3, the engine mounting deck 20 straddles the housing 18 and includes downwardly depending flanges 74 that are laterally spaced from the brackets 48 to which they are secured by fastener bolts 76 as more clearly seen in FIG. 15. Shock absorbing spacers 78 are mounted on the fasteners 76 and the fasteners 80, as shown in FIG. 1, through which the deck flanges 74 are secured to the side wall brackets 48. As shown in FIGS. 8 and 15, an extension 82 is threadedly connected to the fasteners 76 and extend laterally from the deck flanges 74 on opposite sides of the housing. These extensions 82 serve a purpose to be hereinafter explained. Each shock mount assembly also includes a handle guide plate 84 interconnected with the side flanges 74 of the engine deck by fastener bolt assemblies 86 as more clearly seen in FIG. 10. The plate 84 is spaced from the deck flange 74 by a shock absorbing spacer 88 similar to the spacers 78 aforementioned. Each leg of the handle 24 is provided at its end with a sleeve 90 through which a fastener bolt assembly 92 extends for pivotally connecting the handle 24 to the side flanges 74 on the engine deck. As shown in FIG. 8, the handle 24 may be pivotally interconnected by the fastener bolt assembly 92 between the engine deck flange 74 and the guide plate 84 in which case the handle will be limited or restricted in its pivotal swing by abutment with the shock absorbing spacers 88. The handle in such an operational mode will therefore extend upwardly at an incline from the machine to a predetermined height. If it is desired to permit the handle to pivot all the way down to the ground in order to enable compaction of soil or asphalt where overhead clearance is very low, the handle may be mounted on the outside of the handle guide plates 84 as shown in FIG. 9. Thus, the shock mount assemblies 22 not only enable use of the handle 24 in two different operational modes but will also substantially reduce vibration imparted to the handle and thereby reduce operator fatigue. The rearward location of the engine relative to the vibration generator 52 also reduces the vibration transmitted to the handle.

Figure 5:
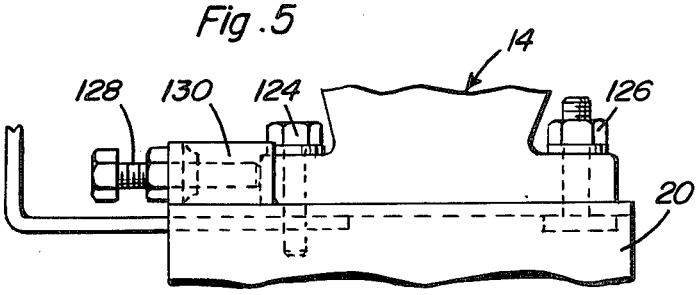
FIG. 5 is a partial side elevation view showing the adjustable mounting of the engine associated with the compacting machine.
Figure 6:
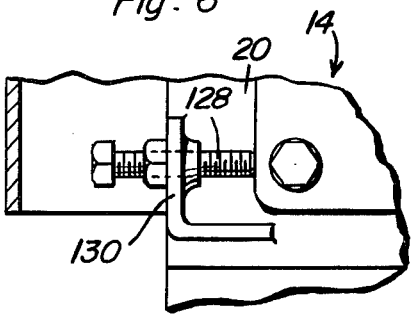
FIG. 6 is a partial top section view of the adjustable mounting structure shown in FIG. 5.
Figure 11:
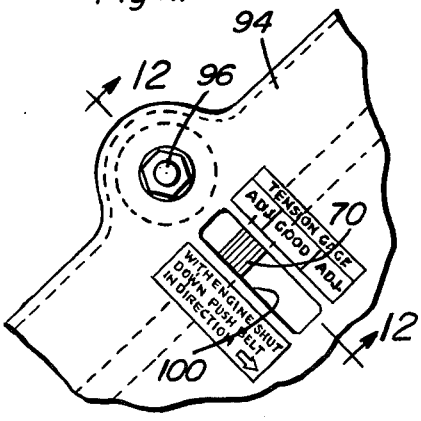
FIG. 11 is an enlarged partial elevation view of a portion of the compacting machine showing the drive belt tension indicator.
Figure 12:
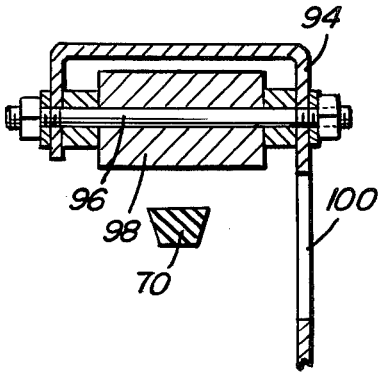
FIG. 12 is an enlarged partial section view taken substantially through a plane indicated by section line 12—12 in FIG. 11.

The vibration imparted to the base 12 also causes alternate tightening and slackening of the endless drive belt 70 aforementioned in connection with FIG. 1. The drive belt as well as the pulleys 68 and 72 about which the drive belt is entrained, are enclosed within a belt guard 94 secured by fasteners 96 to the deck 20 on one lateral side of the machine. The belt guard 94 supports a pivot bolt assembly 96 intermediate the longitudinal ends thereof for rotatably mounting an idler roller 98 arranged to limit the extent to which the belt 70 is outwardly displaced when slackened during each vibration cyle. The belt 70 is also exposed adjacent to the idler roller 98 through a slot 100 formed in the guard 94 as more clearly seen in FIGS. 11 and 12. A tension gauge printed on the exposed surface of the guard 94 adjacent the slot 100 will therefore indicate to the operator the condition of the belt. Appropriate adjustment of belt tension may therefore be effected when required for proper maintenance of the compacting machine. FIGS. 5 and 6 show the facilities provided for adjusting the tension of the belt. Thus, the position of the engine block 14 on the mounting deck 20 may be adjusted by means of the adjustment screw 128 after the fastener bolts 124 and 126 are removed. The adjustment screw 128 is threadedly supported by a bracket 130 secured to the top of the mounting deck 20.

Figure 18:
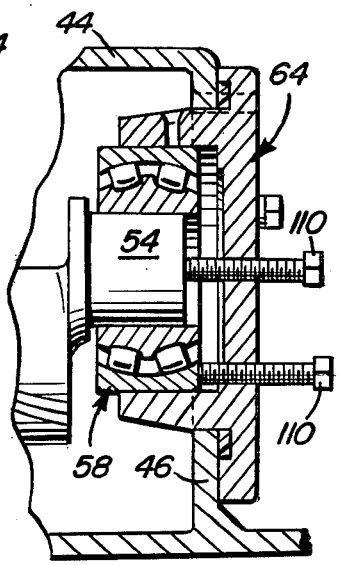
FIG. 18 is a partial section view showing a portion of the eccentric rotor assembly illustrated in FIG. 4, in a partially disassembled condition.

Referring now once again to FIG. 4, the eccentric rotor 53 is provided with an oil mist and air flow directing blade element 102 which is at all times spaced above the static body of lubricant 38 as shown. The blade element 102 converges toward the axial center of the eccentric rotor 53 in order to produce lateral flow toward the side walls 46 of the housing when droplets of oil or lubricant impinge thereon as the rotor is rotating and the lubricant is being displaced by vibration of the base. The oil is thereby misted and directed toward critical lubricating points within the housing such as the roller bearings 58 and 60 and the oil hole 104 formed in the bearing supports 62 and 64. O-ring seals 106 are received within annular recesses formed in the bearing supports for sealing the openings through which the bearing supports project into the side walls 46 of the housing. A sealing gland 108 is mounted by the bearing support 64 in wiping contact with the power shaft 66 to maintain the interior of the housing sealed. A plurality of fastener bolts 110 removably secure the bearing supports 62 and 64 to the side walls 46 of the housing as shown. These fasteners 110 are removed in order to enable disassembly of the vibration generating assembly 52. The bearing supports are therefore also provided with threaded bores 112, 114 and 120 respectively receiving threaded plugs 116, 118 and 122 as shown in FIG. 4. The plugs 116, 118 and 122 are removed so that the bores 112, 114 and 120 may receive the longer fasteners 110 through which the shaft section 54 and bearings 58 and 60 may be axially displaced during disassembly, as shown in FIG. 18. Thus, disassembly of the vibration generator is facilitated without use of special tools.

Figure 16:
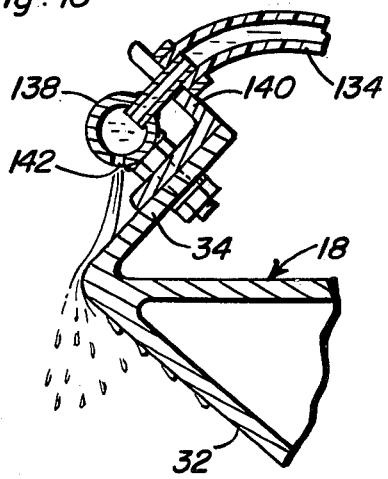
FIG. 16 is an enlarged partial sectional view taken substantially through a plane indicated by section line 16—16 in FIG. 2.

Referring once again to FIG. 1, mounted on the engine forwardly thereof is a water tank 132 to which a hose 134 is connected through a valve assembly 136. Thus, upon opening of the valve 136, water will be conducted through the hose 134 to a laterally extending spray tube 138 mounted by a bracket 140 above the front end flange 34 as more clearly seen in FIG. 16. The bracket 140 is slotted to receive the end of hose 134 connected to the tube 138 which is welded to the fastener assembly 141 clamping the bracket 140 to the flange 34. A plurality of laterally spaced apertures 142 will discharge the water supplied to tube 138 against the flange 34 causing it to wet the undersurface of the base. Use of water for such purpose is particularly desirable in connection with the compaction of asphalt to avoid adhesion thereof to the base.

Figure 17:
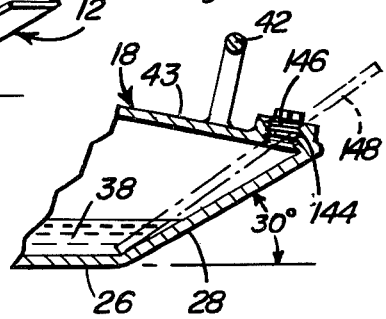
FIG. 17 is an enlarged partial section view taken substantially through a plane indicated by section line 17—17 in FIG. 7.

Lubricant or oil may be added to the body of lubricant 38 confined within the housing 18 through a filler opening 144 on the rear inclined portion 43 as more clearly seen in FIG. 17. A plug 146 ordinarily closes the opening 144 at the rear end of the machine on top of the housing 18. The foregoing arrangement not only enables insertion of a dip stick 148 as shown by dotted line in FIG. 17, in order to measure the level of the oil within the housing, but also facilitates draining of all oil from the housing by tilting the base rearwardly onto the rear end surface portion 28 by a smaller amount such as 30° than that ordinarily required.

Figure 13:
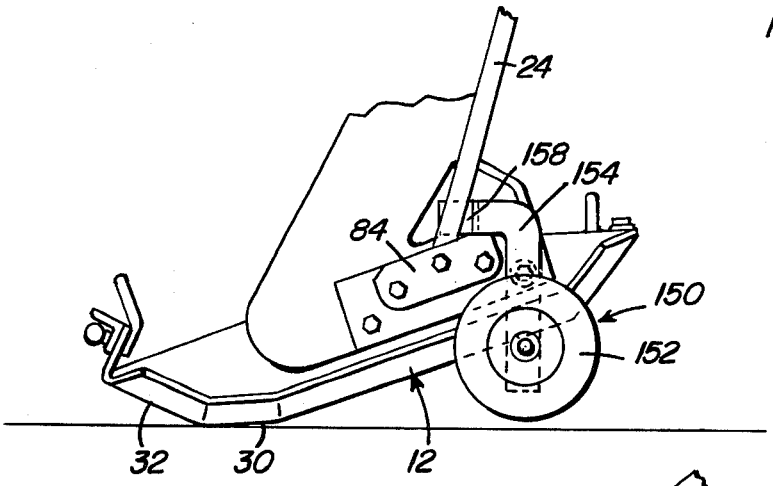
FIG. 13 is a partial side elevation view of the compacting machine in a tilted position for receiving removable wheel supporting assemblies.
Figure 14:
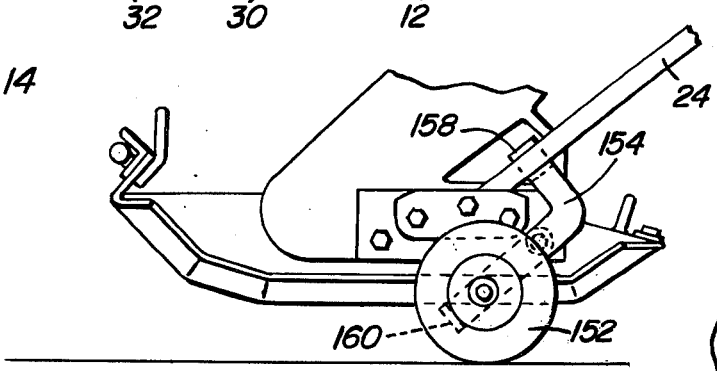
FIG. 14 is a partial side elevational view of the compacting machine in a horizontal wheel supported position.

The base of the machine may also be tilted onto the front end sections 30 and 32 as shown in FIG. 13 in order to accommodate installation of a pair of wheel assemblies 150 in order to facilitate transport of the machine from one place to another while not in operation. Each wheel assembly therefore includes a wheel 152 rotatably mounted on a bracket 154 adapted to be pivotally connected to the machine. Toward that end, the bracket is provided with a sleeve 156 as shown in FIG. 15 adapted to slidably receive an extension 82. The wheel brackets 154 when mounted onto the machine in its tilted position as shown in FIG. 13, will have upper arm portions 158 positioned behind the leg portions of the handle 24. When the base 12 of the machine is then restored to its horizontal position as shown in FIG. 14, the load of the machine will be transferred to the wheels 152 causing pivotable displacement of the wheel brackets 154 to the positions shown in FIG. 14. In such positions, load engaging tabs 160 on the brackets 154 will engage the underside of the base to limit further pivotal movement of the wheel brackets. The upper arm portions 158 will then abut the leg portions of the handle 24 in order to lock the handle and the wheel brackets 154 in place relative to the machine. This rigid assembly of the wheel brackets and handle 24 will thereby enable the operator to wheel the machine to a desired location.

In summary, the base 12 of the machine as hereinbefore described is designed so that material which is deposited onto it will be vibrated off the base. The amount of cleaning necessary is therefore reduced. Further, checking of the lubricant level within the housing 18 is facilitated through the drain opening 144 by means of which the oil may be fully drained and replaced when required, with a minimum of effort. Toward that end, the front end of the machine need only be lifted and the machine rearwardly displaced by only 30°. To disassemble the vibration generator 52, the fasteners 110 are removed from the bearing supports and the plug 116 then removed. A fastener 110 may then be threadedly inserted through the bore 112 in order to axially displace the shaft section 54 from the bearing 58 as shown in FIG. 18. The plugs 118 and 120 may then be removed in order to similarly displace the bearings 58 and 60 from bearing supports 62 and 64. Also, adjustment of the belt tension may be timely made by virtue of the indicator slot 100 formed in the belt guard 94 adjacent to the idler roller 98 for limiting slackening movement of the belt.

The shape of the base and the relationship thereof to the longitudinally elongated housing 18 within which the lubricant is confined, not only enhances the strength of the base plate but also provides mounting surfaces for the engine deck 20 and the shock mounting assemblies 22. Direct heat transfer between the lubricant and the planar bottom portion 26 of the base not only enhances dissipation of heat from the bearing surfaces within the housing but also warms the base in order to avoid sticking of asphalt material thereto. Further, the oil and air within the housing is constantly misted and displaced to the critical lubricating points by the flow inducing blade 102 on the eccentric rotor 53.

The locational relationships between the vibration generator 52 and the engine 14 also establishes peak vibration amplitude at a desired location while reducing the vibration imparted to the engine and the handle 24. The dual vibration isolating shock mount assemblies 22 further reduce the vibrations imparted to the engine and the handle. Flexibility in the mounting of the handle is also provided by the shock mount assemblies as aforementioned. To facilitate transport of the compacting machine while not in operation, the removable wheel assemblies 150 are provided arranged to be installed by tilting of the base at its forward end portion. When installed, the wheel assemblies will carry the load of the machine and in doing so will form a rigid connection with the handle.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A vibratory compactor, comprising a base having a planar bottom portion adapted to be in contact with material to be compacted, a forward end portion, a rear end portion and spaced lateral side portions, housing means connected to the base in spaced relation to said lateral side portions and extending between the forward and rear end portions for confining a body of coolant in direct contact with the planar bottom portion of the base, vibration generating means mounted within the housing means above the planar bottom portion of the base for imparting vibration thereto and to the body of lubricant, a power generator drivingly connected to the vibration generating means for operation thereof, and misting means mounted on the vibration generating means in out of contact relation to the body of lubricant in a static condition for laterally directing the coolant displaced by said vibration from said body of lubricant into lubricating relation to the vibration generating means.

2. The combination of claim 1 wherein said coolant is a lubricant.

3. The combination of claim 2 wherein at least one of said forward and rear end portions of the base extends longitudinally from the planar bottom portion at a predetermined upward inclination, and filler access means mounted on the housing means above said one of the end portions of the base for draining the coolant in response to tilting of the base by an amount equal to said predetermined inclination.

4. The combination of claim 3 including means mounting the power generator on the base rearwardly spaced from the vibration generating means, fastener means connecting the base to the mounting means having wheel supporting extensions, and detachable wheel asemblies adapted to be pivotally mounted on said wheel supporting extensions upon tilting of the base about said forward end portion.

5. The combination of claim 4 wherein said vibration generating means includes spaced bearing supports mounted on said housing means in axial alighment with each other, anti-friction bearing devices mounted in said supports within the housing means, an eccentric rotor rotatably mounted by said bearing devices within the housing means above the body of coolant in said static condition and fasteners detachably securing the bearing supports to the housing means, the power generator including a power shaft connected to the eccentric rotor and extending therefrom through one of the bearing supports externally of the housing means.

6. The combination of claim 5 wherein the bearings supports are provided with plugged bores in alignment with the bearing devices and the eccentric rotor, said fasteners being insertable into the bores for displacement of the bearing devices and the rotor from assembled relation to the bearing supports.

7. The combination of claim 6 wherein said misting means includes a flow directing blade mounted on the rotor and spaced from the body of lubricant in all positions of the rotor.

8. The combination of claim 1 including means mounting the power generator on the base rearwardly spaced from the vibration generating means, fastener means connecting the base to the mounting means having wheel supporting extensions, and detachable wheel asemblies adapted to be pivotally mounted on said wheel supporting extensions upon tilting of the base about said forward end portion.

9. The combination of claim 1 wherein said vibration generating means includes spaced bearing supports mounted on said housing means in axial alighment with each other, anti-friction bearing devices mounted in said supports within the housing arms, an eccentric rotor rotatably mounted by said bearing devices within the housing means above the body of coolant in a static condition and fasteners detachably securing the bearing supports to the housing means, the power generator including a power shaft connected to the eccentric rotor and extending therefrom through one of the bearing supports externally of the housing means.

10. The combination of claim 9 wherein the bearing supports are provided with plugged bores in alignment with the bearing devices and the eccentric rotor, said fasteners being insertable into the bores for displacement of the bearing devices and the rotor from assembled relation to the bearing supports.

11. The combination of claim 9 wherein said misting means includes a flow directing blade mounted on the rotor.

12. In a vibratory compactor, a base having a planar bottom portion adapted to be in contact with material to be compacted, a forward end portion, and a rear end portion, housing means connected to the base for confining a body drivingly connected to the vibration generating means for operation thereof, one of said end portions of the base extending from the planar bottom portion at a predetermined upward inclination, and filler access means mounted on the housing means above said one of the end portions of the base for draining the coolant in response to tilting of the base by an amount equal to said predetermined inclination.

13. In a vibratory compactor having a base, housing means for confining a static body of lubricant in direct contact with the base, vibration generating means for imparting vibration to the base and the body of lubricant and misting means mounted on the vibration generating means in out of contact relation to the static body of lubricant for laterally directing the lubricant displaced by said vibration from the body of lubricant into lubricating relation to the vibration generating means.

14. The combination of claim 13 wherein said vibration generating means includes an eccentric rotor, said misting means including a flow directing blade mounted on the rotor spaced from the static body of lubricant in all positions of the rotor.

15. The combination of claim 13 wherein said vibration generating means includes spaced bearing supports mounted on said housing means in axial alignment with each other, anti-friction bearing devices mounted in said supports within the housing means, an eccentric rotor rotatably mounted by said bearing devices within the housing means above the body of lubricant in a static condition and fasteners detachably securing the bearing supports to the housing means, the power generator including a power shaft connected to the eccentric rotor and extending therefrom through one of the bearing supports externally of the housing means.

16. The combination of claim 15 wherein the bearing supports are provided with plugged bores in alignment with the bearing devices and the eccentric rotor, said fasteners being insertable into the bores for displacement of the bearing devices and the rotor from assembled relation to the bearing supports.

* * * * *